US012390060B1

(12) United States Patent
Chen

(10) Patent No.: US 12,390,060 B1
(45) Date of Patent: Aug. 19, 2025

(54) TOILETING DEVICE FOR CHILDREN

(71) Applicant: Taizhou Huangyan Yujin E-commerce Co., Ltd., Zhejiang (CN)

(72) Inventor: Hui Chen, Zhejiang (CN)

(73) Assignee: TAIZHOU HUANGYAN YUJIN E-COMMERCE CO., LTD., Taizhou (CN)

( * ) Notice: Subject to any disclaimer, the term of this patent is extended or adjusted under 35 U.S.C. 154(b) by 0 days.

(21) Appl. No.: 19/032,845

(22) Filed: Jan. 21, 2025

(30) Foreign Application Priority Data

Jan. 15, 2025 (CN) ..... 202520095274.7

(51) Int. Cl.
*A47K 11/06* (2006.01)
*A47C 12/02* (2006.01)

(52) U.S. Cl.
CPC ..... *A47K 11/06* (2013.01); *A47C 12/02* (2013.01)

(58) Field of Classification Search
CPC A47K 11/00; A47K 11/04–045; A47K 11/06; A47K 11/08
See application file for complete search history.

(56) References Cited

U.S. PATENT DOCUMENTS 8,776,279 B2 * 7/2014 Smith ..... A47K 11/06 4/237
9,596,965 B2 * 3/2017 Sundberg ..... A47K 13/00
2024/0349956 A1 * 10/2024 Sauceda ..... A47K 17/028

FOREIGN PATENT DOCUMENTS

JP 3643668 * 4/2005 ..... A47K 11/04
JP 2014097245 * 5/2014 ..... A47K 11/04

* cited by examiner

*Primary Examiner* — David P Angwin
*Assistant Examiner* — Nicholas A Ros

(57) ABSTRACT

A retractable toileting device for children includes a base, a second stool, a toilet rim, a potty and a cover plate which are detachably provided on the base, the base is provided with a first receiving cavity with a first opening at the bottom. The toilet rim is detachably provided on the base, when in using state, the toilet rim is assembled to the base to form a toliting device with the base. The cover plate is assembled to the top of the base and forms a first stool with the base, when a second stool in the using state, which is placed above the first stool and forms a step with the first stool, to allow the product to be used as a toilet, stool and step for multi-functionality.

20 Claims, 13 Drawing Sheets

TOILETING DEVICE FOR CHILDREN

CROSS-REFERENCE TO RELATED APPLICATIONS

The present invention claims priority of Chinese patent application CN2025200952747, filed on Jan. 15, 2025, which is incorporated herein by reference in its entireties.

TECHNICAL FIELD

The present invention relates to the technical field of children's products, in particular to a toileting device for children.

BACKGROUND toliting device vary in size, the most important ones are width and height, due to the children's body condition, if toliting device is too high, children will be tiring to sit on it, if toliting device is too wide, the children's legs will be widely apart which is very inconvenient, at the same time, the inner ring of an adult toilet is relatively large, and the children's butt is very easy to fall down to get stuck inside, which is unsafe. For this reason, toliting devices have appeared on the market.

At present, the existing toliting devices are large in volume, and take up a lot of space, which results in high transportation costs and are inconvenient to store and carry out, moreover, the existing toliting devices are only suitable for children toileting, and have a single function.

SUMMARY

The main purpose of the present invention provides a toileting device for children, to solve the problems of existing toliting devices that are bulky, inconvenient to store and have single functions.

In order to overcome the deficiencies of the prior art, the technical solutions provided by the present invention are as follows.

A toileting device for children includes a base, the base is provided with a first receiving cavity with a first opening at the bottom. A potty is detachably provided on the base, the potty at least partially is arranged in the first receiving cavity. A toilet rim adapts for use by children, the toilet rim is detachably provided on the base, the toilet rim provides with a first through hole, when in a first using state, the first through hole is located at the position corresponding to the potty, the toilet tim is assembled to the base and forms the toileting device with the base, when in storage state, the toilet rim is at least partially placed in the first receiving cavity. A cover plate is detachably provided on the top of the base, the cover plate is assembled to a top of the base and forms a first stool with the base. When in the second using state, a second stool is placed above the first stool and forms a step with the first stool, the second stool is placed in the first receiving cavity and is located above the toilet rim when in the storage state.

Furthermore, the cover plate is provided with a first limiting slot, when a bottom of the second stool is placed in the first limiting slot to limit movement of the second stool relative to the first stool.

Furthermore, the second stool is provided with a second receiving cavity with a second opening at a bottom of the second receiving cavity, when in the storage state, the at least a part of the potty is placed in the first receiving cavity, and the at least a part of the potty is placed in the second receiving cavity.

Furthermore, an inner surface of the base is provided with a second limiting slot for limiting a position of the second stool, and when in the storage state, the bottom of the second stool is placed in the second limiting slot.

Furthermore, a boss is formed on a top of the base, both the cover plate and a bottom of the toilet rim are provided with a third limiting slot matching to a size of the boss, the boss is placed in the third limiting slot, when in the second using state, a bottom of the cover plate is in contact with a peripheral side of the base locating in the boss, and when in the first using state, a bottom of the toilet rim is in contact with the peripheral side of the base locating in the boss.

Furthermore, a top surface of the cover plate is provided with an anti-slip portion, and a top surface of the second stool is provided with an anti-slip pad.

Furthermore, a top of the second stool is provided with a fourth limiting slot, and the anti-slip pad is at least partially placed in the fourth limiting slot.

Furthermore, the anti-slip pad and the second stool are fixed together through a rubber coating process.

Furthermore, the cover plate is provided with a reinforcing ribs for increasing a strength of the cover plate.

Furthermore, a bottom of the second stool is provided with a first anti-slip footpad, and the bottom of the base is provided with a second anti-slip footpad.

Furthermore, both the cover plate and toilet rim are detachably connected to the base through snap-fit.

Furthermore, both sides of the base are provided a first clamping blocks, both the cover plate and the toilet rim are provided with a first bayonet matching with the first clamping blocks, the first clamping blocks are placed in the first bayonets when the cover plate is assembled to the base or when the toilet rim is assembled to the base.

Furthermore, both sides of the base are provided an installation slots, both sides of the base are provided with a connection piece, both sides of the wall of the base are provided with a second bayonets corresponding to the installation slots, the connection pieces are at least partially placed in the installation slots, both sides of the connection pieces are provided with a second clamping block, the second clamping blocks are placed in the second bayonets, a side of the connection piece adjacent to the base is provided with a first connection plate, the first clamping blocks are located at a bottom of the first connection plates, both sides of the cover plate and the toilet rim are provided with a second connection plate, and the first bayonets are placed on the upper surface of the second connection plates.

Furthermore, the toilet rim is provided with a backrest for reclining.

Furthermore, the top of the toilet rim is provided with a limiting convex block, the limiting convex block is located in front of the first through hole, and a distance between the limiting convex block and the backrest is greater than a width of the second stool.

Furthermore, the toilet rim includes a first casing made of soft rubber, a second casing is fixed together with the first casing through a rubber coating process, the first through hole passes through the first casing and the second casing.

Furthermore, the toileting device for children further comprises a toilet lid, the toilet lid places over the toilet rim and covers the first through hole, a bottom of the toilet lid is provided with an annular limiting block make matching the first through hole, when the toilet lid is placed on the toilet rim, the annular limiting block is placed in the first through hole.

Furthermore, a gap is formed between at least a part of the toilet lid and the toilet rim.

Furthermore, a top of the base is provided with a second through hole, a position of the first through hole is opposite to a position of the second through hole, the potty is provided with an abutting edge, the potty passes through the second through hole, the abutting edge contacts against a surface of the base located in the second through hole, the base is provided with a groove on a peripheral side of the second through hole, the abutting edge is at least partially placed in the groove, and a surface of the base is provided with an avoidance opening adjacent to the second through hole to facilitate a user to take the potty.

Furthermore, both sides of the base are provided with an access opening for easy accessing the base, and the base is provided with a cushion pad on the access opening.

BRIEF DESCRIPTION OF THE DRAWINGS

In order to more clearly illustrate the technical solutions in the embodiments of the present invention, the accompanying drawings to be used in the description of the embodiments will be briefly described below, the accompanying drawings in the following description are only some embodiments of the present invention, for ordinary person skilled in the art, other drawings obtained from these drawings without paying creative labor by an ordinary person skilled in the art should be within scope of the present disclosure.

FIG. 7 is an enlarged view of FIG. 6 at region a.

DETAILED DESCRIPTION OF THE EMBODIMENTS

The accompanying drawings in the embodiment of the present disclosure are combined, the technical scheme in the embodiment of the present disclosure is clearly and completely described. Obviously, the described embodiment is only a part of the embodiment of the present disclosure, but not all embodiments are based on the embodiment of the present disclosure, and all other embodiments obtained by ordinary technicians in the field on the premise of not doing creative work belong to the protection range of the present disclosure.

Figure 1:
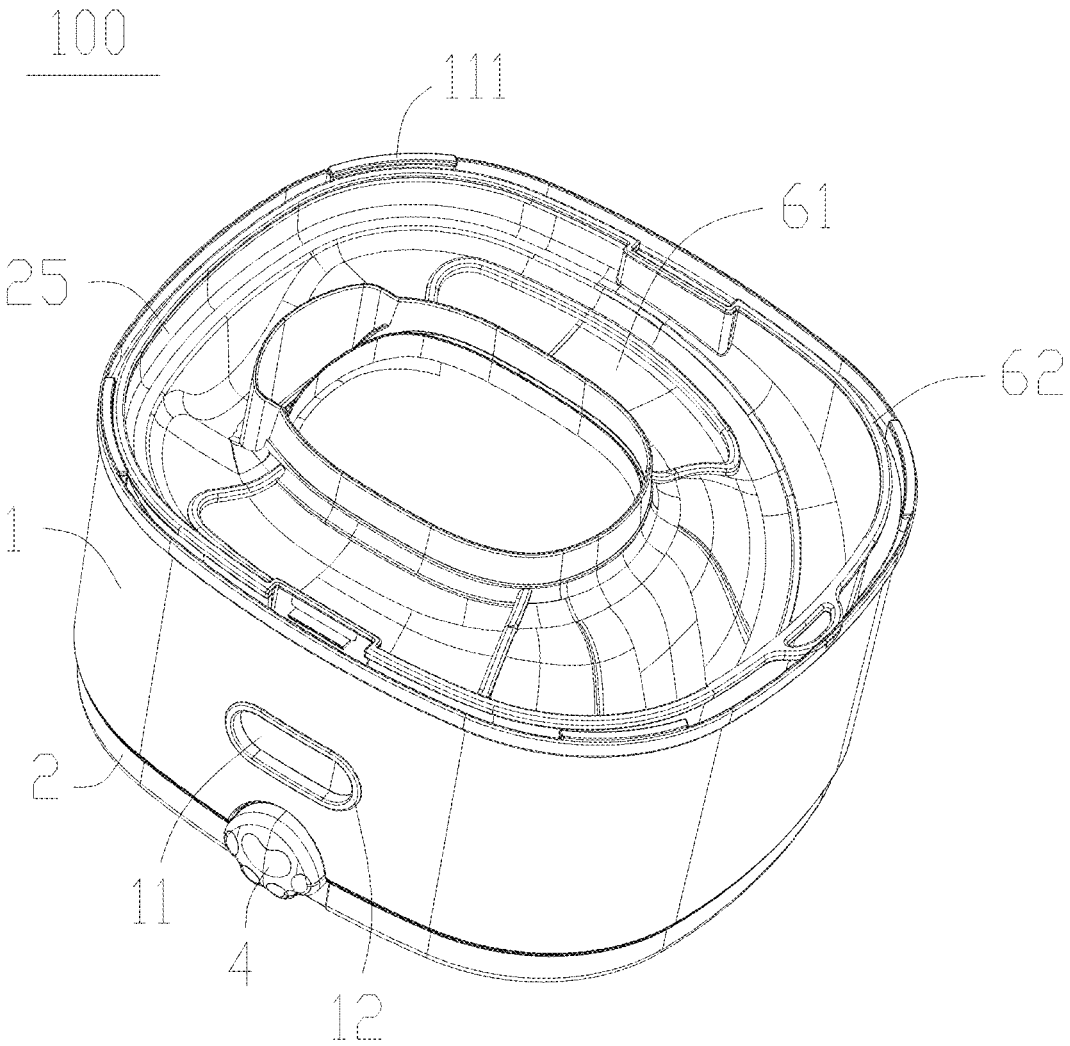
FIG. 1 is a schematic view of a storage state according to the present invention.
Figure 2:
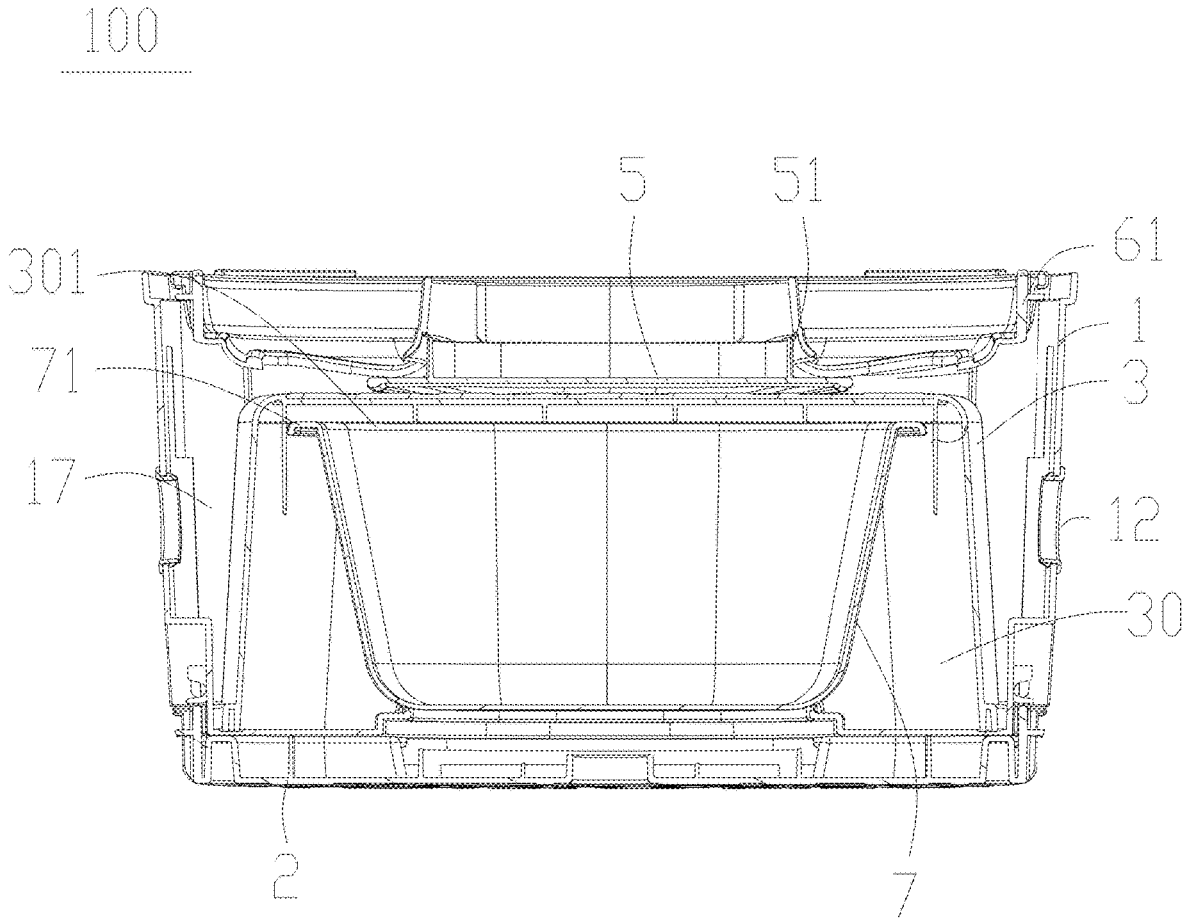
FIG. 2 is a sectional view sectional when a connection pieces and a first casing are removed and sectioned along the centerline of the access opening according to the present invention.
Figure 3:
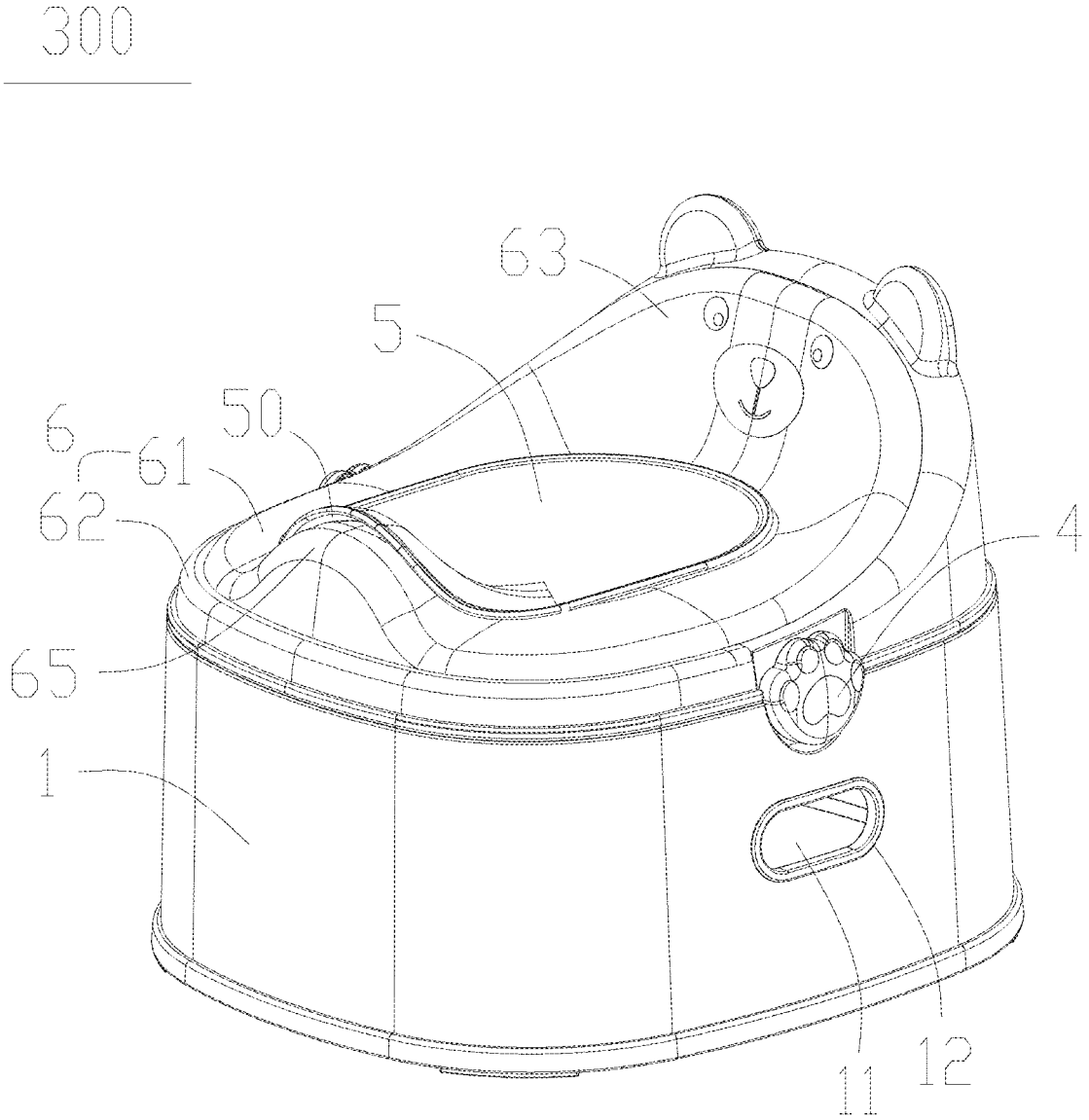
FIG. 3 is a status diagram of a a first using state according to the present invention.
Figure 4:
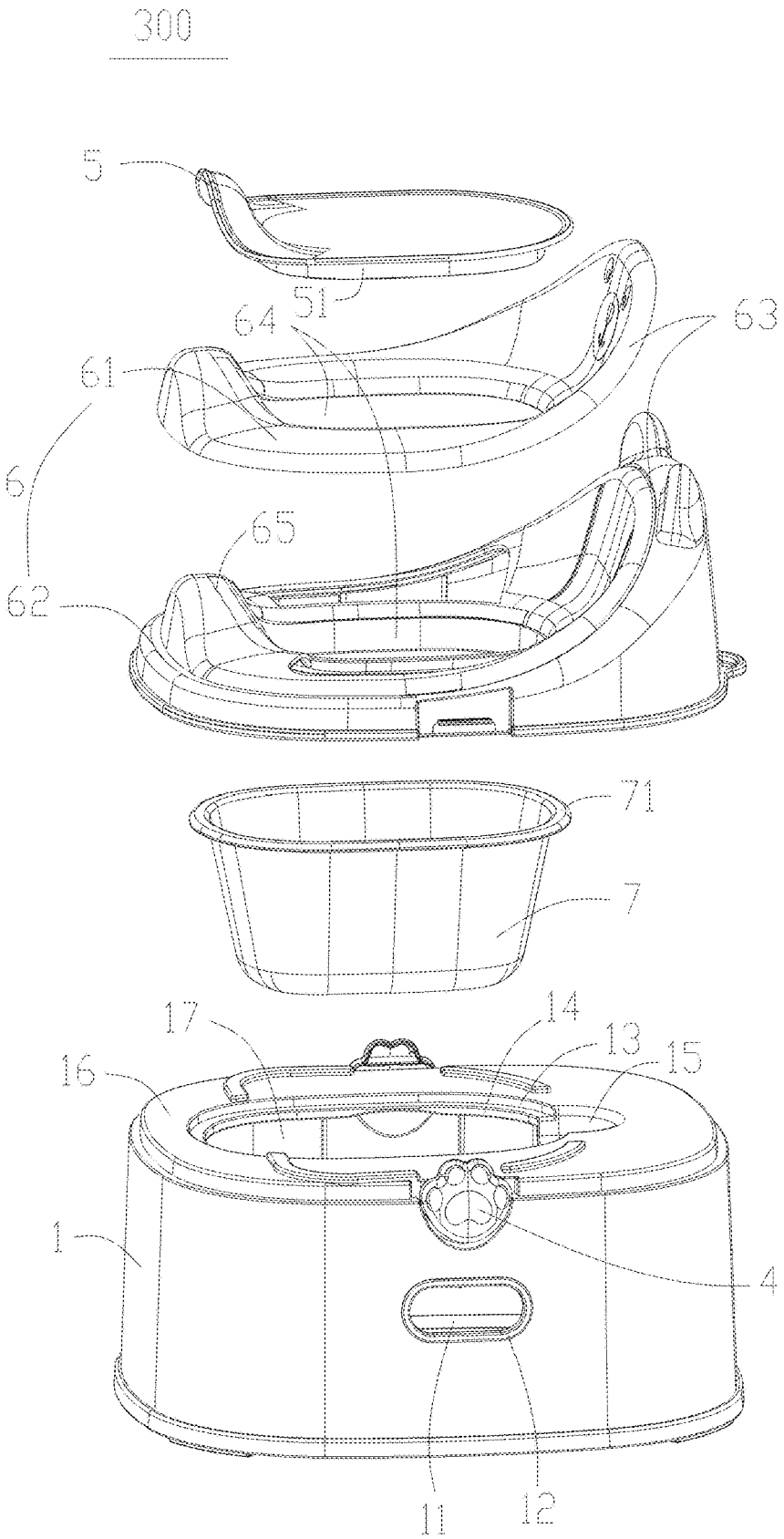
FIG. 4 is an exploded diagram of the toileting device according to the present invention.
Figure 5:
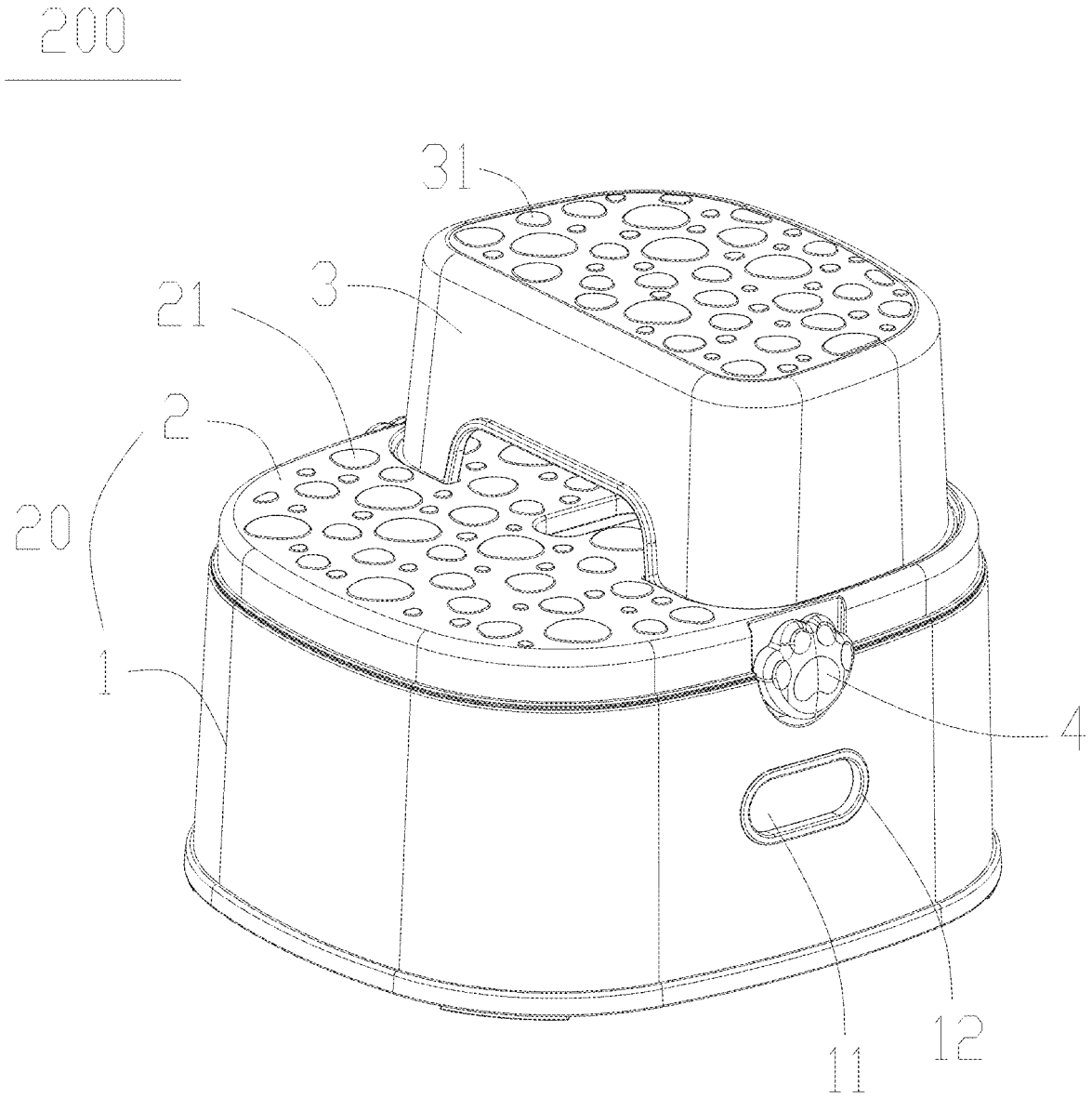
FIG. 5 is a schematic diagram when in a second using state according to the present invention.
Figure 6:
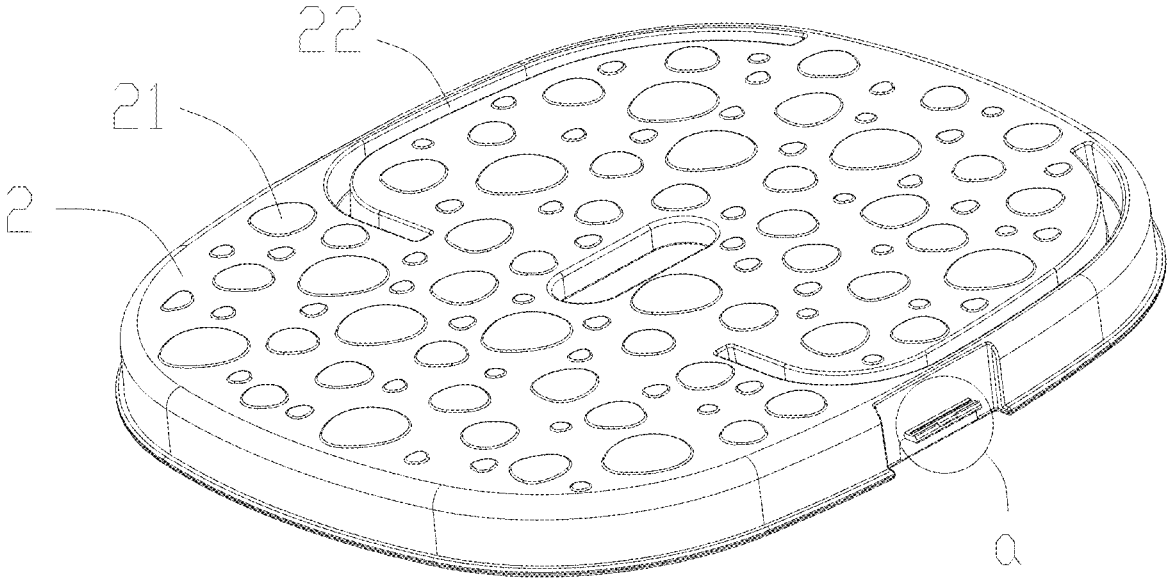
FIG. 6 is a structural diagram of a cover plate according to the present invention.
Figure 7:
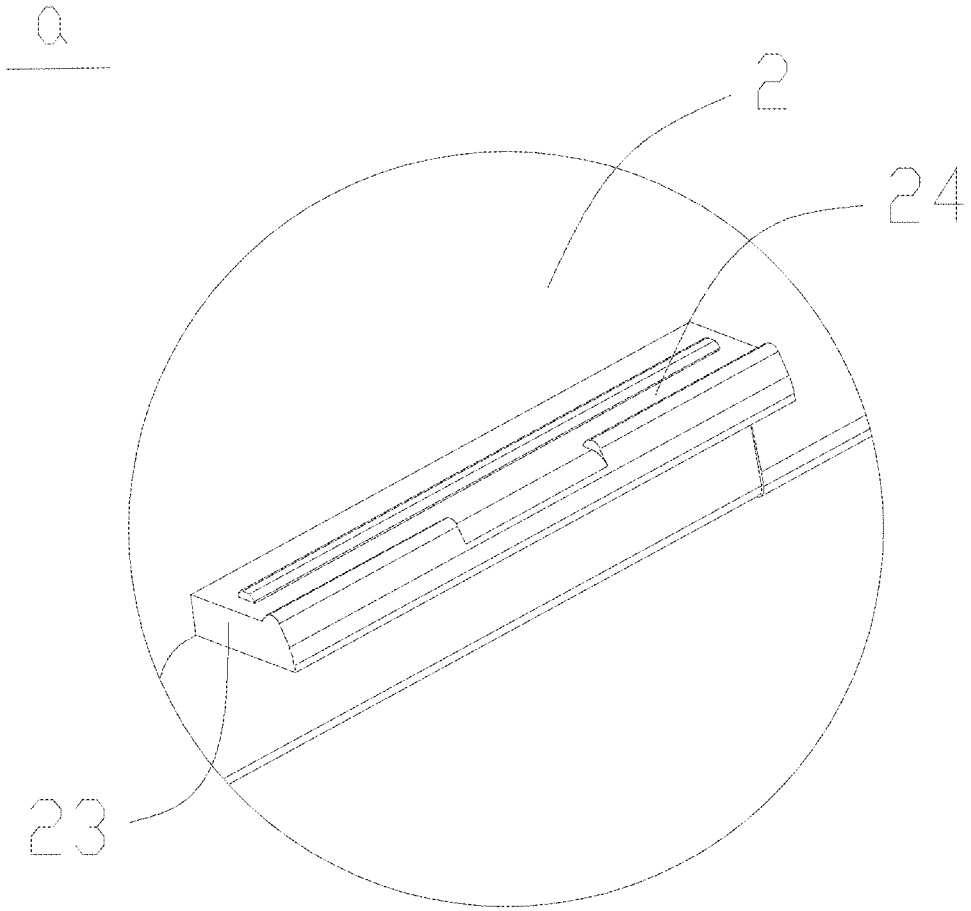
Figure 8:
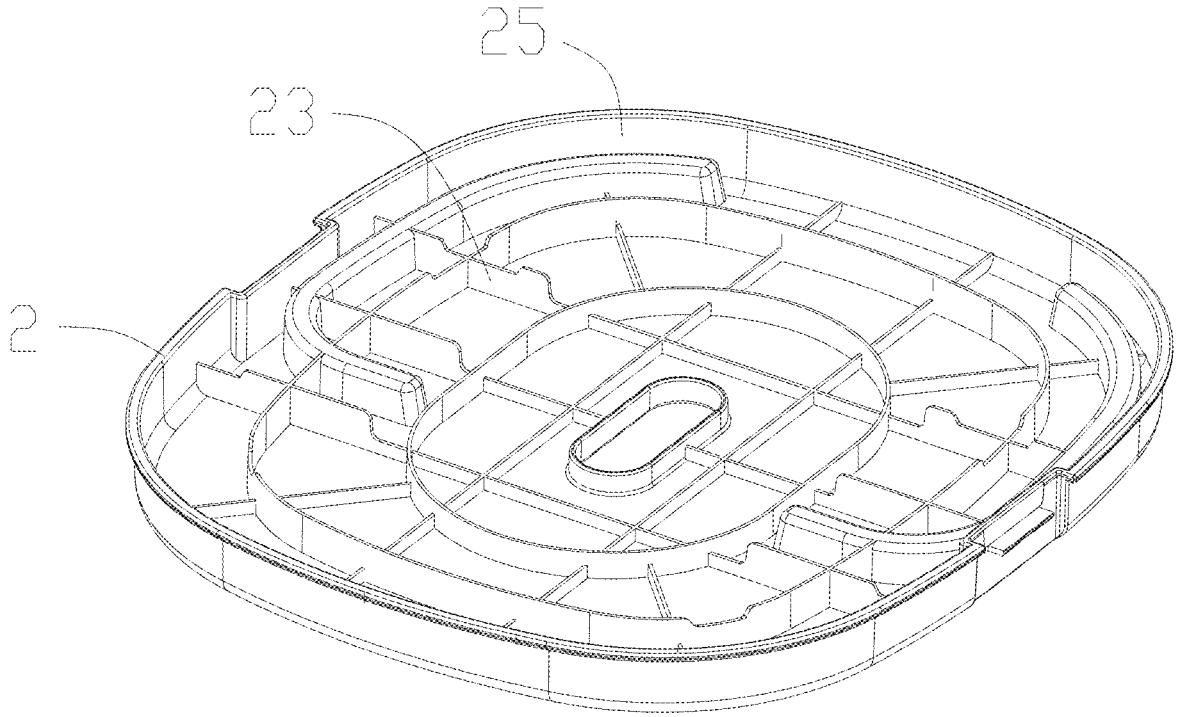
FIG. 8 is a structural diagram of another view of the cover plate according to the present invention.
Figure 9:
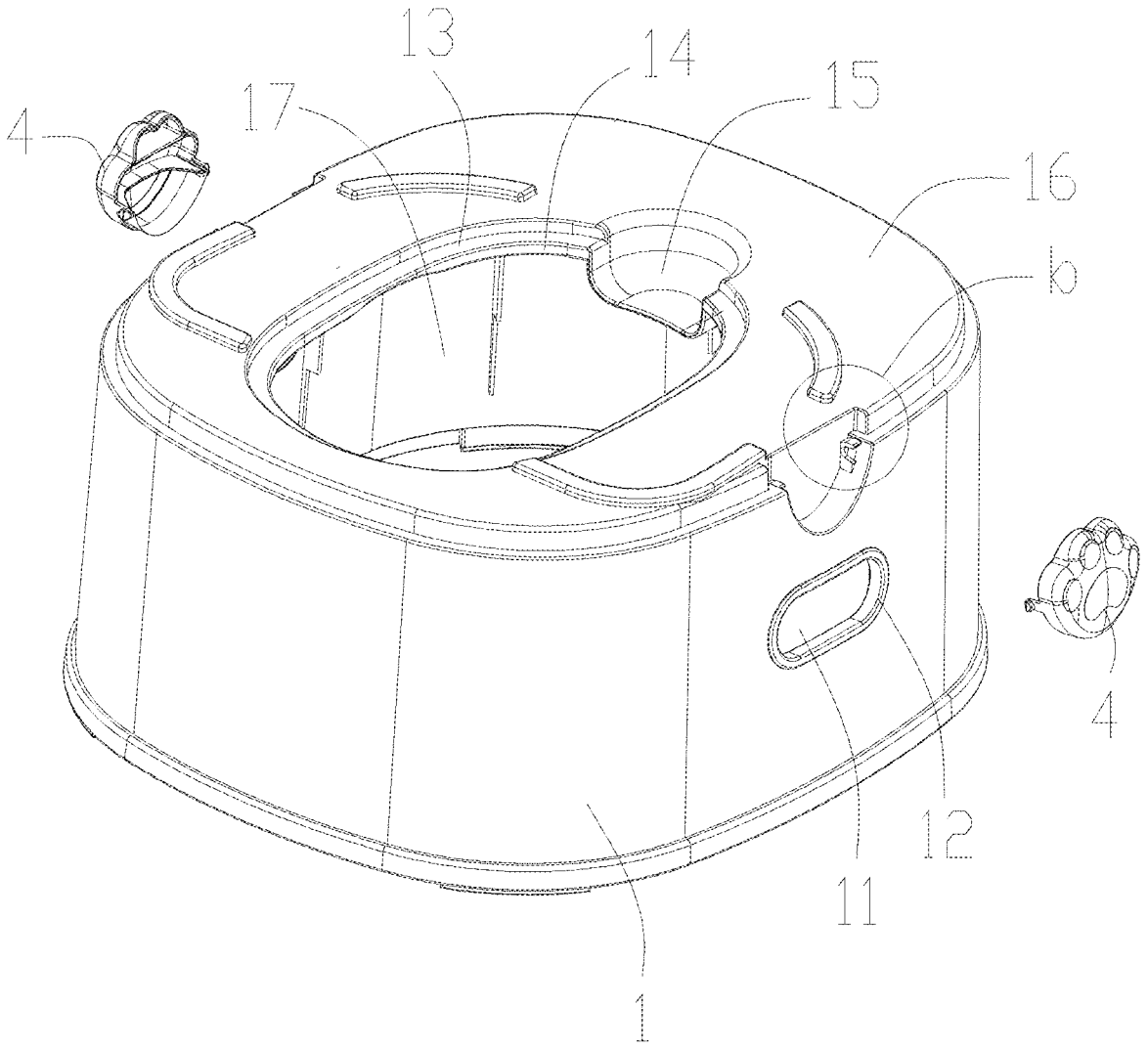
FIG. 9 is an exploded diagram of a base and the connection pieces according to the present invention.
Figure 10:
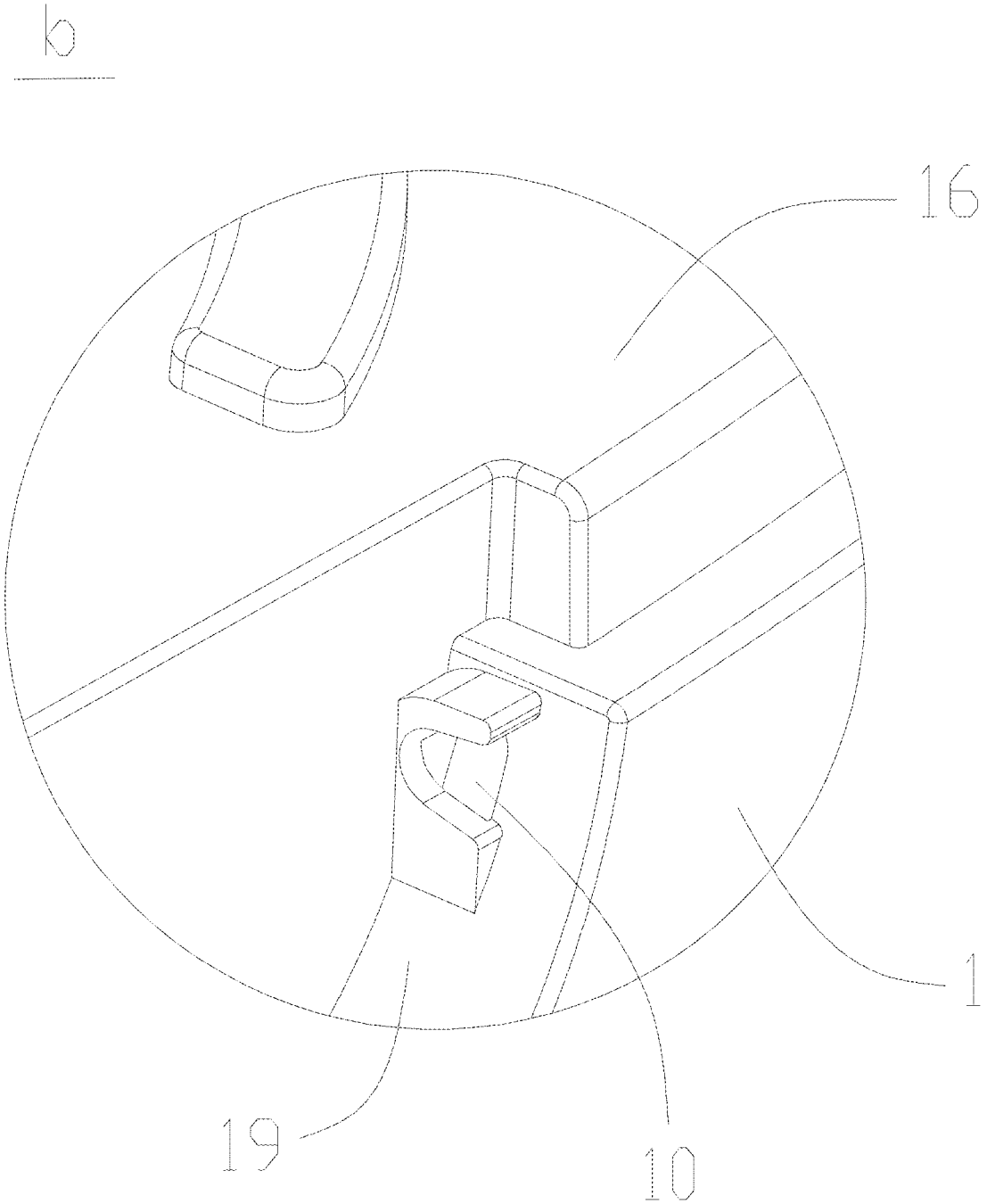
FIG. 10 is an enlarged view of FIG. 9 at region b.
Figure 11:
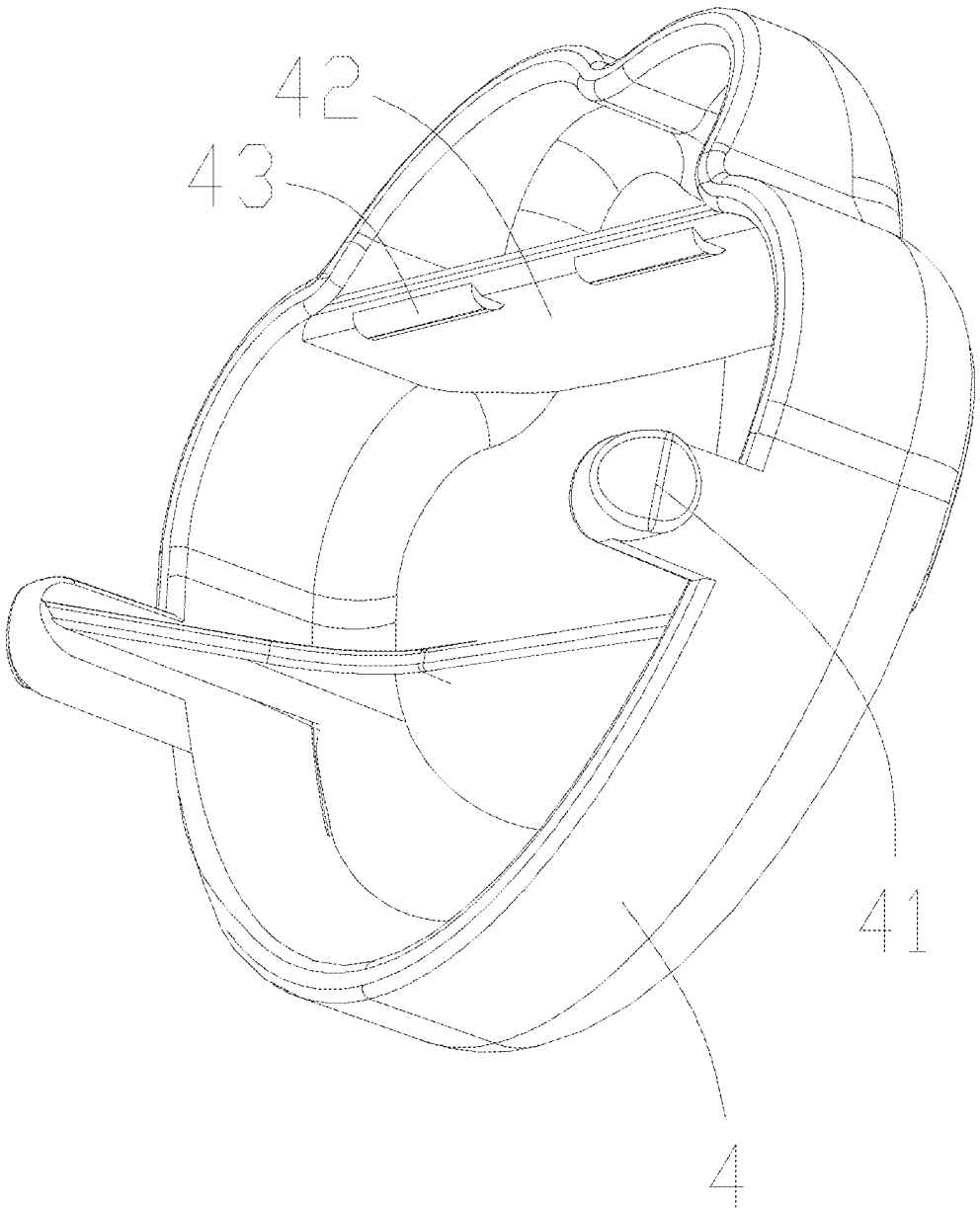
FIG. 11 is a structural diagram of the connection pieces according to the present invention.
Figure 12:
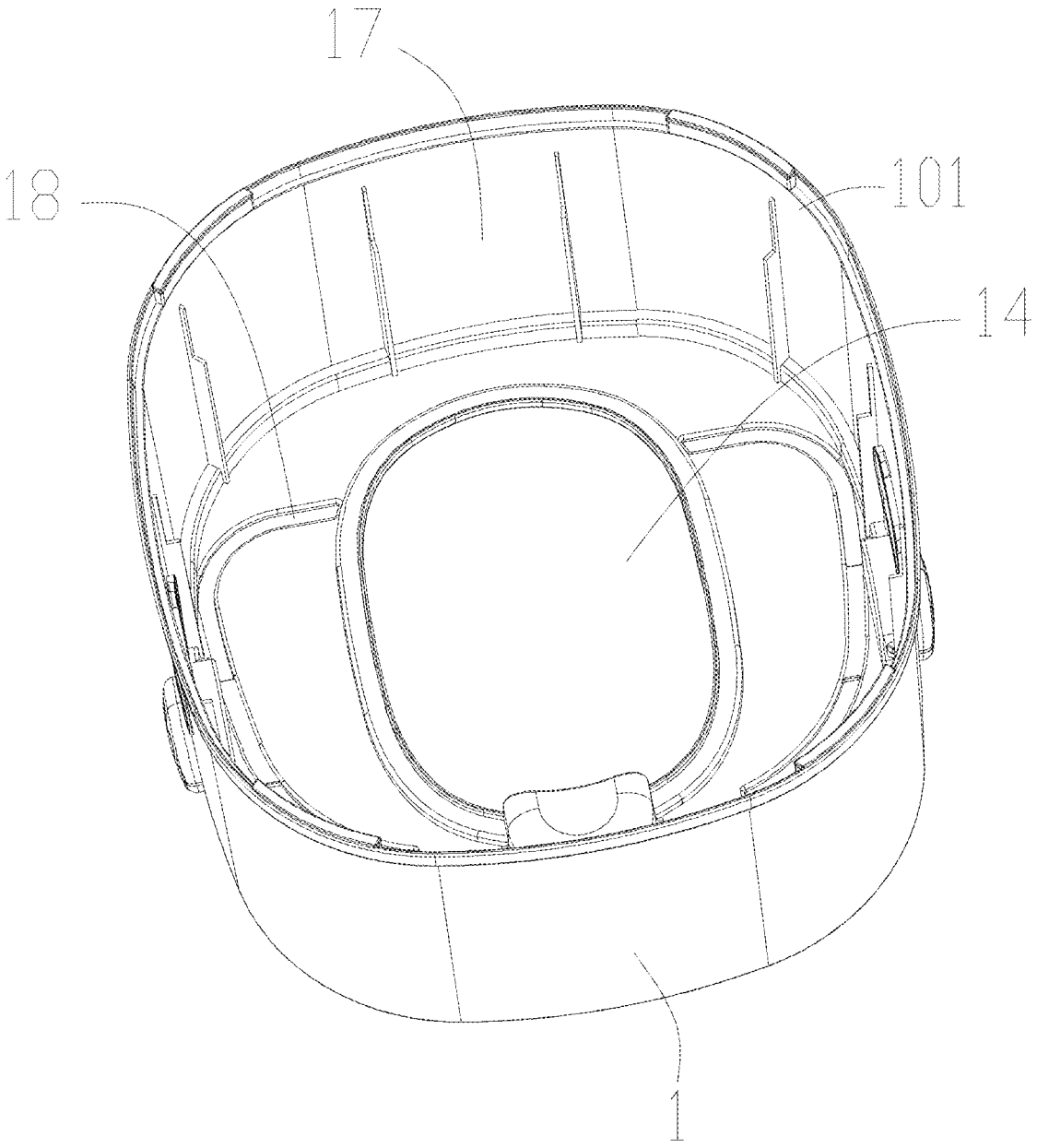
FIG. 12 is a structural diagram of another view of the base according to the present invention.
Figure 13:
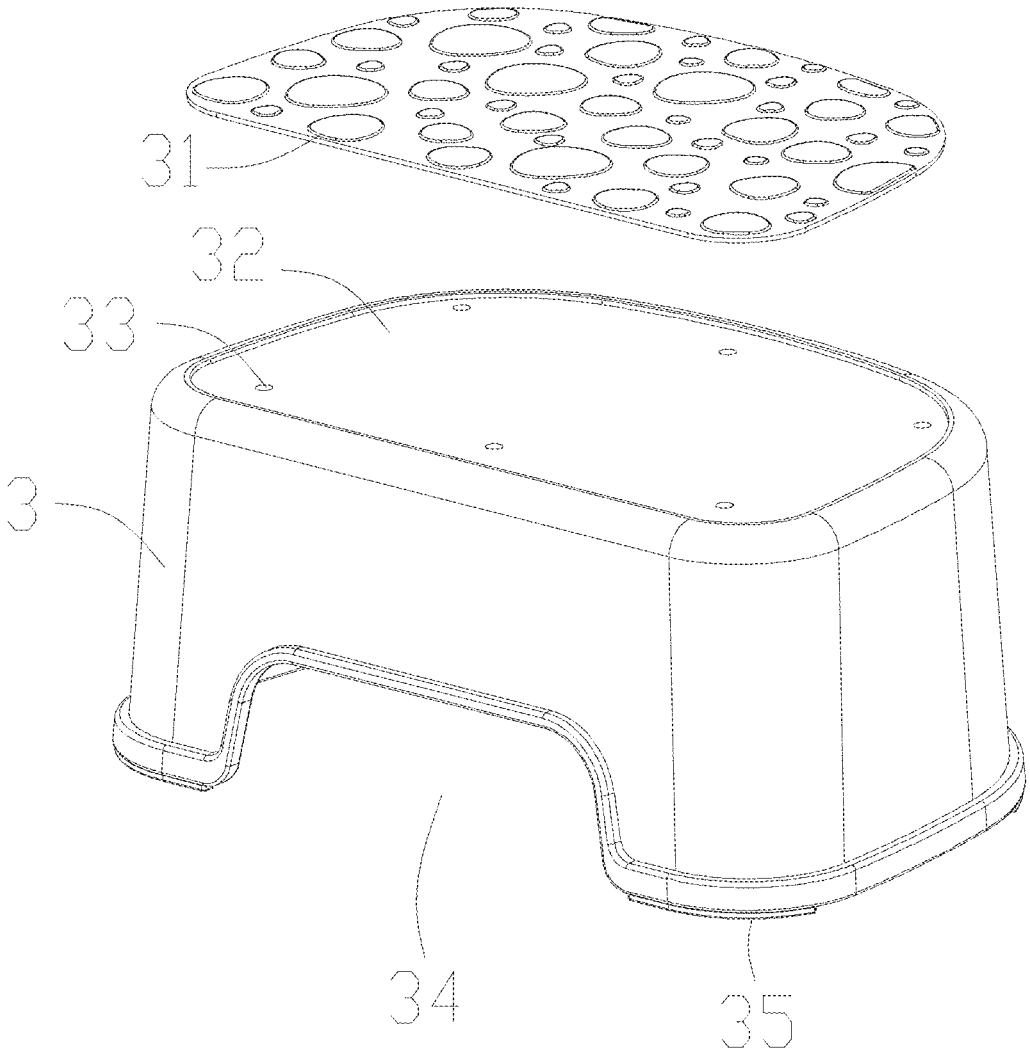
FIG. 13 is an exploded diagram of a second stool and an anti-slip pad according to the present invention.
Figure 14:
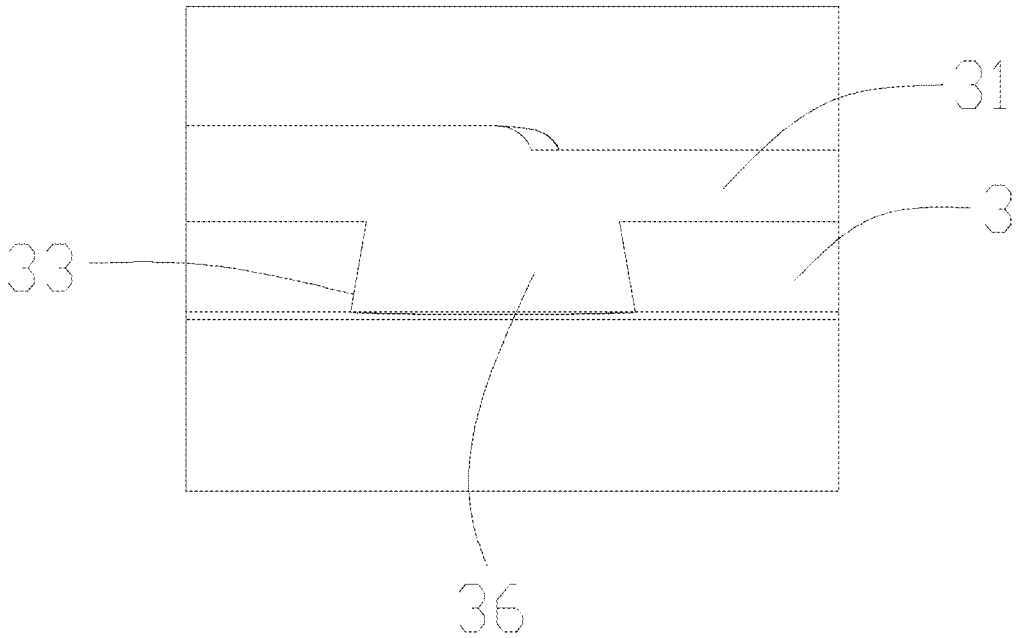
FIG. 14 is a sectional diagram of a docking block places inside a docking opening according to the present invention.

Referring to FIG. 1 to FIG. 14, a toileting device for children 100 of embodiment according to the present invention.

The toileting device for children 100 includes a base 1, a second stool 3, a toilet rim 6 adapts for use by children, a potty 7 and a cover plate 2 are detachably provided on the base 1, the base 1 is provided with a first receiving cavity 17 with a first opening 101 at the bottom, the potty 7 at least partially is arranged in the first receiving cavity 17. The toilet rim 6 is detachably provided on the base 1, the toilet rim 6 provides with a first through hole 64 at the position corresponding to the potty 7, the toilet tim 6 is assembled to the base 1 and forms the toileting device 300 with the base 1 when in a first using state, the toilet rim 6 is at least partially placed in the first receiving cavity 17 when in the storage state. The cover plate 2 is assembled to a top of the base 1 and forms a first stool 20 with the base 1, the second stool 3 is placed above the first stool 20 and forms a step 200 with the first stool 20, the second stool 3 is placed in the first receiving cavity 13 and is located above the toilet rim 6 when in the storage state.

In the embodiment, the detachable toilet rim 6 is disposed on the base 1, when the toilet rim 6 is installed on the base 1, which can be combined with the potty 7 provided on the base 1 to form a toileting device 300 for using by the users. The cover plate 2 is combined with the base 1 to form the first stool 20, which realizing that the product of the embodiment uses as a stool. Further, by combining the second stool 3 with the first stool 20, the step 200 can be formed for children to use in places such as the sink, thereby realizing multi-functionality of the product and improving the practicality of the product. In addition, the toilet rim 6 and the second stool 3 can be placed in the base 1 when in the transportation or storage state, so as to effectively reduce the volume of the product, facilitate transportation, and make the product easy for the user to store and carry outside. Furthermore, the toilet rim 6 and the base 1 are detachably connected, and the toilet rim 6 can be placed on an adult toilet, so that the adult toilet can be used by children.

In the embodiment, the cover plate 2 is provided with a first limiting slot 22 for limiting the position of the first stool 20. When the second stool 3 forms the step 200 with the first stool 20, the bottom of the second stool 3 is placed in the first limiting slot 22. When the first stool 20 and the second stool 3 form the step 200, the first limiting slot 22 is used to limit the position of the second stool 3 to prevent relative movement between the first stool 20 and the second stool 3.

Specifically, both the front and rear sidewalls of the second stool 3 are provided a through holes, so that the legs of the second stool 3 form a bracket shape, to adapte the bottom of the second stool 3 for using. Of course, in other embodiments, the shape of the bottom of the second stool 3 and the first limiting slot 22 can be annular, straight, etc.

In the embodiment, the second stool 3 is provided with a second receiving cavity 30 with a second opening 301 at the bottom. When in the storage state, the potty 7 at least partially is placed in the first receiving cavity 17, and at least partially is placed in the second receiving cavity 30, in this way, the space can be effectively utilized to minimize the volume of the stored product of this embodiment. Specifically, when the toileting device for children 100 in the storage state, the cover plate 2 can be assembled on the top of the base 1 or placed in the first receiving cavity 17 together with the toilet rim 6, the potty 7 can be placed with the state of a toileting device or the potty 7 can be placed upside down in the first receiving cavity 17.

In the embodiment, an inner surface of the base 1 is provided with a second limiting slot 18 for limiting the position of the second stool 3, and when the second stool 3 is in the storage state, the bottom of the second stool 3 is placed in the second limiting slot 18, to limit the position of the second stool 3, which prevents the second stool 3 from colliding with a side wall of the first receiving cavity 17 during transportation or carrying, thereby improving the user's experience.

In the embodiment, the top surface of the cover plate 2 is provided with an anti-slip portion 21, whereby, the anti-slip portion 21 may be formed by a protrusion on the top surface of the cover plate 2, or the anti-slip portion 21 may be an anti-slip texture, or perhaps, the anti-slip portion 21 may be an anti-slip rubber pad and so on. The top surface of the second stool 3 is provided with an anti-slip pad 31 for anti-slip, whereby the anti-slip pad 31 may be formed by a protrusion on the top surface of the second stool 3, or the anti-slip pad 31 may be an anti-slip texture, or perhaps, the anti-slip pad 31 may be an anti-slip rubber pad and so on.

In the embodiment, the top of the second stool 3 is provided with a fourth limiting slot 32, and the anti-slip pad 31 is at least partially placed in the fourth limiting slot 32, to limit the position of the anti-slip pad 31, and to prevent from protruding, improving the aesthetics of the product.

In the embodiment, the anti-slip pad 31 and the second stool 3 are fixed together using a rubber coating process, the anti-slip pad 31 is connected to the second stool 3.

In the embodiment, the top of the second stool 3 is provided with a docking opening 33, the bottom of the anti-slip pad 31 raises to form a docking block 36 used to match the docking opening 33, a cross-sections of the docking block 36 and the docking port 33 are both splay-shaped, I-shaped, etc., the docking block 36 is placed in the docking opening 33. By using the docking block 36 to match with the docking opening 33, the stability of the connection between the second stool 3 and the anti-slip pad 31 can be improved.

Of course, in other embodiments, the anti-slip pad 31 can be fixed to the second stool 3 by buckling, sticking, etc.

In the embodiment, the cover plate 2 is provided with a reinforcing ribs 23 for increasing the strength of the cover plate 2, specifically, the reinforcing ribs 23 are located inside of the cover plate 2.

In the embodiment, the bottom of the second stool 3 is provided with a first anti-slip footpad 35 for anti-slip, and the bottom of the base 1 is provided with a second anti-slip footpad 111, which prevents the second stool 3 and the base 1 from slipping during use and affecting use.

In the embodiment, a boss 16 is formed on the top of the base 1, both the cover plate 2 and the bottom of the toilet rim 6 are provided with a third limiting slot 25 matching to the size of the boss 16, the boss 16 is placed in the third limiting slot 25. When the bottom of the cover plate 2 is in the second using state which is in contact with the peripheral side of the base 1 locating in the boss 16, and when the bottom of the toilet rim 6 is in the first using state which is in contact with the peripheral side of the base 1 locating in the boss 16. This allows the cover plate 2 and the toilet rim 6 to be stably assembled to the base 1, to prevent shaking problems, and this structure can make the structures of the first stool 20 and the toileting device 300 more compact and stable.

In the embodiment, both the cover plate 2 and toilet rim 6 are detachably connected to the base through snap-fit, to prevent the cover plate 2, or the first stool 20 formed by the toilet rim 6 and the base 1, or the toliting device from falling off the base 1, and to improve the stability of the cover 2 or the toilet rim 6 being assembled to the base 1.

Specifically, both sides of the base 1 are provided a first clamping block 43, both the cover plate 2 and the toilet rim 6 are provided with a first bayonet 24 matching with the first clamping blocks 43, the first clamping blocks 43 are placed in the first bayonets 24 when the cover plate 2 is assembled to the base 1 or when the toilet rim 6 is assembled to the base 1, in order to stably connect the cover plate 2 or the toilet rim 6 with the base 1.

In the embodiment, both sides of the base 1 are provided an installation slot 19, both sides of the base 1 are provided with a connection piece 4, both sides of the wall of the base 1 are provided with a second bayonet 10 corresponding to the installation slots 19, the connection pieces 4 are at least partially placed in the installation slots 19, both sides of the connection pieces 4 are provided with a second clamping block 41, the second clamping blocks 41 are placed in the second bayonets 10. A side adjacent to the base 1 of the connection pieces 4 is provided with a first connection plates 42, the first clamping blocks 43 are located at the bottom of the first connection plates 42. Both sides of the cover plate 2 and the toilet rim 6 are provided with a second connection plate 23, and the first bayonets 24 are placed on the upper surface of the second connection plates 23. The first connection plates 42 are located above the second clamping blocks 41, the second clamping blocks 41 match the second bayonets, which allows the connection pieces 4 to form a lever. When the first clamping blocks 43 are placed in the first bayonets, the connection pieces 4 can be fixed, to connect the base 1 with the cover plate 2 or the toilet rim 6 through the connection pieces 4. When the user needs to remove the cover plate 2 or the toilet rim 6 from the base 1, who can press near the bottom position of the connection pieces 4, with the second clamping blocks 41 as a pivot point, the other end of the connection pieces 4 overcome the force of the first clamping blocks 43 placed in the first bayonets 24, in order to allow the connection pieces 4 to release the cover plate 2 or the toilet rim 6, at this time the user can remove the cover plate 2 or the toilet rim 6 from the base 1.

In the embodiment, the toilet rim 6 is provided with a backrest 63 for reclining, for children toileting.

In the embodiment, the top of the toilet rim 6 is provided with a limiting convex block 65, the limiting convex block 65 is located in front of the first through hole 64, to use of the limiting convex block 65, which allows the children to be better aligned to sit on the toilet rim 6 for toileting, and serves as a limiting effect for the children.

In the embodiment, the distance between the limiting convex block 65 and the backrest 63 is greater than the width of the second stool 3, when the product is in the storage state, the second stool 3 can be located between the backrest 63 and the limiting convex block 65, to prevent the second stool 3 from abutting against the backrest 63 or the top of the limiting convex block 65, thereby increasing the storage volume. And when the width between the limiting convex block 65 and the backrest 63 matches the second stool 3, which can play a role in limiting the position of the second stool 3, to prevent the second stool 3 from shaking during transportation.

In the embodiment, the toilet rim 6 includes a first casing 61 which is made of soft rubber, a second casing 62 which is fixed together with the first casing 61 using a rubber coating process. The first through hole 64 passes through the first casing 61 and the second casing 62, to improve the strength of the toilet rim 6 and increase the compactness of the toilet rim 6 structure. And the first casing 61 made of soft rubber can improve the comfort of using the toilet rim 6.

Of course, in other embodiments, the first casing 61 and the second casing 62 may be fixed by pasting, buckling, etc.

In the embodiment, the toileting device for children 100 further includes a toilet lid 5, the toilet lid 5 places over the toilet rim 6 and covers the first through hole 64, to hide the potty 7 and prevent the potty 7 from exposing. The bottom of the toilet lid 5 is provided with an annular limiting block 51 make matching the first through hole 64, when the toilet lid 5 is placed on the toilet rim 6, the annular limiting block 51 is placed in the first through hole 64, to limit the position of the toilet lid 5, and to allow the toilet lid 5 to be aligned to cover the first through hole 64.

In the embodiment, a gap 50 is formed between at least part of the toilet lid 5 and the toilet rim 6, which is convenient for the user to take the toilet lid 5 and use the toliting device 300.

In the embodiment, the top of the base 1 is provided with a second through hole 14, the position of the first through hole 64 is opposite to the position of the second through hole 14, the potty 7 is provided with an abutting edge 71, the potty 7 passes through the second through hole 14, the abutting edge 71 contacts against a surface of the base 1 located in the second through hole 14, to realize that the potty 7 is detachably connected to the base 1.

In the embodiment, the base 1 is provided with a groove 13 on the peripheral side of the second through hole 14, the abutting edge 71 is at least partially placed in the groove 13, to prevent the abutting edge 71 from protruding and affecting the aesthetics of the product.

In the embodiment, the surface of the base 1 is provided with an avoidance opening 15 adjacent to the second through hole 14, the avoidance opening 15 is used to expose the abutting edge 71 of the t potty 7 to facilitate the user to take and place the potty 7.

In the embodiment, both sides of the base 1 are provided with an access opening 11, and the base 1 is provided with a cushion pad 12 on the access opening 11, to facilitate user to move the product of the embodiment.

It should be noted that all directional indications (such as up, down, left, right, front, back . . . ) in the embodiments of the present disclosure are only used to explain a relative positional relationship between components, motion situations, etc. at a certain specific attitude (as shown in the figures). If the specific attitude changes, the directional indication also correspondingly changes.

In addition, the descriptions of "first", "second", etc. in the present disclosure are only used for descriptive purposes, and cannot be understood as indicating or implying its relative importance or implicitly indicating the number of technical features indicated. Therefore, features defined by "first" and "second" can explicitly instruct or impliedly include at least one feature. In addition, "and/or" in the entire text includes three solutions. A and/or B is taken as an example, including technical solution A, technical solution B, and technical solutions that both A and B satisfy. In addition, the technical solutions between the various embodiments can be combined with each other, but it needs be based on what can be achieved by those of ordinary skill in the art. When the combination of the technical solutions is contradictory or cannot be achieved, it should be considered that such a combination of the technical solutions does not exist, and is not within the scope of protection claimed by the present disclosure.

The above descriptions are only preferred embodiments of the present disclosure, and are not intended to limit the patent scope of the present disclosure. Any equivalent structural transformation made by using the content of the specification and the drawings of the present disclosure under the invention idea of the present disclosure, directly or indirectly applied to other related technical fields, shall all be included in the scope of patent protection of the present disclosure.

What is claimed is:

1. A toileting device for children, comprising:

a base, the base provided with a first receiving cavity with a first opening at the bottom, a potty detachably provided on the base, at least a part of the potty arranged in the first receiving cavity, a toilet rim configured for using by children, wherein the toilet rim is detachably provided on the base, the toilet rim provides with a first through hole, when in a first using state, the first through hole is located at a position corresponding to the potty, the toilet trim is assembled to the base and forms the toileting device with the base, when in a storage state, at least a part of the toilet rim is placed in the first receiving cavity, a cover plate detachably provided on the top of the base, wherein when in a second using state, the cover plate is assembled to the top of the base and forms a first stool with the base, a second stool, wherein in the second using state, the second stool is placed above the first stool and forms a step with the first stool, the second stool is placed in the first receiving cavity and is located above the toilet rim when in the storage state.

2. The toileting device for children according to claim 1, wherein the cover plate is provided with a first limiting slot, when a bottom of the second stool is placed in the first limiting slot to limit movement of the second stool relative to the first stool.

3. The toileting device for children according to claim 1, wherein the second stool is provided with a second receiving cavity with a second opening at a bottom of the second receiving cavity, when in the storage state, the at least a part of the potty is placed in the first receiving cavity, and the at least a part of the potty is placed in the second receiving cavity.

4. The toileting device for children according to claim 3, wherein an inner surface of the base is provided with a second limiting slot for limiting a position of the second stool, and when in the storage state, the bottom of the second stool is placed in the second limiting slot.

5. The toileting device for children according to claim 1, wherein a boss is formed on a top of the base, both the cover plate and a bottom of the toilet rim are provided with a third limiting slot matching to a size of the boss, the boss is placed in the third limiting slot, when in the second using state, a bottom of the cover plate is in contact with a peripheral side of the base locating in the boss, and when in the first using state, a bottom of the toilet rim is in contact with the peripheral side of the base locating in the boss.

6. The toileting device for children according to claim 1, wherein a top surface of the cover plate is provided with an anti-slip portion, and a top surface of the second stool is provided with an anti-slip pad.

7. The toileting device for children according to claim 6, wherein a top of the second stool is provided with a fourth limiting slot, and the anti-slip pad is at least partially placed in the fourth limiting slot.

8. The toileting device for children according to claim 7, wherein the anti-slip pad and the second stool are fixed together through a rubber coating process.

9. The toileting device for children according to claim 1, wherein the cover plate is provided with a reinforcing ribs for increasing a strength of the cover plate.

10. The toileting device for children according to claim 1, wherein a bottom of the second stool is provided with a first anti-slip footpad, and the bottom of the base is provided with a second anti-slip footpad.

11. The toileting device for children according to claim 1, wherein both the cover plate and toilet rim are detachably connected to the base through snap-fit.

12. The toileting device for children according to claim 11, wherein both sides of the base are provided a first clamping blocks, both the cover plate and the toilet rim are provided with a first bayonet matching with the first clamping blocks, the first clamping blocks are placed in the first bayonets when the cover plate is assembled to the base or when the toilet rim is assembled to the base.

13. The toileting device for children according to claim 12, wherein both sides of the base are provided an installation slots, both sides of the base are provided with a connection piece, both sides of the wall of the base are provided with a second bayonets corresponding to the installation slots, the connection pieces are at least partially placed in the installation slots, both sides of the connection pieces are provided with a second clamping block, the second clamping blocks are placed in the second bayonets, a side of the connection piece adjacent to the base is provided with a first connection plate, the first clamping blocks are located at a bottom of the first connection plates, both sides of the cover plate and the toilet rim are provided with a second connection plate, and the first bayonets are placed on the upper surface of the second connection plates.

14. The toileting device for children according to claim 1, wherein the toilet rim is provided with a backrest for reclining.

15. The toileting device for children according to claim 14, wherein the top of the toilet rim is provided with a limiting convex block, the limiting convex block is located in front of the first through hole, and a distance between the limiting convex block and the backrest is greater than a width of the second stool.

16. The toileting device for children according to claim 1, wherein the toilet rim comprises a first casing made of soft rubber, a second casing is fixed together with the first casing through a rubber coating process, the first through hole passes through the first casing and the second casing.

17. The toileting device for children according to claim 1, wherein the toileting device for children further comprises a toilet lid, the toilet lid places over the toilet rim and covers the first through hole, a bottom of the toilet lid is provided with an annular limiting block make matching the first through hole, when the toilet lid is placed on the toilet rim, the annular limiting block is placed in the first through hole.

18. The toileting device for children according to claim 17, wherein a gap is formed between at least a part of the toilet lid and the toilet rim.

19. The toileting device for children according to claim 1, wherein a top of the base is provided with a second through hole, a position of the first through hole is opposite to a position of the second through hole, the potty is provided with an abutting edge, the potty passes through the second through hole, the abutting edge contacts against a surface of the base located in the second through hole, the base is provided with a groove on a peripheral side of the second through hole, the abutting edge is at least partially placed in the groove, and a surface of the base is provided with an avoidance opening adjacent to the second through hole to facilitate a user to take the potty.

20. The toileting device for children according to claim 1, wherein both sides of the base are provided with an access opening for easy accessing the base, and the base is provided with a cushion pad on the access opening.

* * * * *